US006533714B1

(12) United States Patent
Sarritzu

(10) Patent No.: US 6,533,714 B1
(45) Date of Patent: Mar. 18, 2003

(54) INERTIZATION OF WASTE MATERIAL CONTAMINATED WITH HEAVY METALS

(75) Inventor: Graziano Sarritzu, Quartu So Elena Ca (IT)

(73) Assignee: Ecotec S.r.l., Siracusa (IT)

( * ) Notice: Subject to any disclaimer, the term of this patent is extended or adjusted under 35 U.S.C. 154(b) by 0 days.

(21) Appl. No.: 09/623,389

(22) PCT Filed: Mar. 4, 1998

(86) PCT No.: PCT/IT98/00046

§ 371 (c)(1),
(2), (4) Date: Nov. 14, 2000

(87) PCT Pub. No.: WO99/44688

PCT Pub. Date: Sep. 10, 1999

(51) Int. Cl.[7] ..... A62D 3/00
(52) U.S. Cl. ..... 588/256; 588/257; 423/659
(58) Field of Search ..... 588/256, 257; 423/659

(56) References Cited

U.S. PATENT DOCUMENTS 4,737,356 A 4/1988 O'Hara et al.
5,788,623 A * 8/1998 Studer et al. ..... 588/256
5,931,773 A * 8/1999 Pisani et al. ..... 588/256

FOREIGN PATENT DOCUMENTS

| | | |
|---|---|---|
| EP | 0 568 903 | 11/1993 |
| GB | 2 277 515 | 11/1994 |
| WO | 97 31874 | 9/1997 |

* cited by examiner

*Primary Examiner*—Steven Bos
(74) *Attorney, Agent, or Firm*—Browdy and Neimark

(57) ABSTRACT

Method for treating waste material contaminated with heavy metals so as to make it inert, characterized in that the material to be made inert, optionally at least in part neutralized, is subjected to the following operations, optionally under stirring: addition of a concentrate aqueous solution of orthophosphoric acid and an alkaline or alkaline earth salt thereof in a molar ration ranging from 1:5 to 5:1; optionally addition of water to give the homogeneous paste thus obtained a sufficient moisture content; addition of calcium hydroxide and/or calcium oxide; the resulting homogeneous paste being placed in the open air to help it dry out. The material thus obtained is fit to be disposed according to local environmental legislation.

18 Claims, No Drawings

INERTIZATION OF WASTE MATERIAL CONTAMINATED WITH HEAVY METALS

CROSS REFERENCE TO RELATED APPLICATION

The present application is the national stage under 35 U.S.C. 371 of PCT/IT98/00046, filed Mar. 4, 1998.

1. Field of the Invention

The present invention relates to a method for treating waste material contaminated with heavy metals so as to make the waste material. The treatment involves the use of calcium hydroxide and/or calcium oxide and a concentrated aqueous solution of orthophosphoric acid and a salt thereof with an alkaline or alkaline earth metal.

2. Background of the Invention

As is known, special and/or toxic harmful waste material from various sources containing heavy metals, such as arsenic, cadmium, chromium, mercury, lead, selenium and tellurium, which is liable to produce in transfer tests an eluate that does not comply with the established acceptability limits, needs to be disposed of in secured landfills for hazardous toxic wastes.

The prior art in this specific area records many techniques which allow metals to be immobilized in stable matrices, thereby making them chemically inert and thus preventing their leaching and of thereby allowing these types of waste material to be disposed under less severe conditions (leaching tests within limits imposed by national and international legislation).

Very often, these types of waste material have a composition which requires, for sufficient stabilization, the use of large amount of reagents, such as for example cement, or the use of expensive products, accompanied by long maturation times. Other solidification techniques make use of additives, such as slag, triturated bricks, pebble gravel, and sand mixed with bentonite, which results in excessive increases in the final weight and volume, accompanied by modest results in limiting the leaching o the metals.

In order to lower the binder component for example in the case of ash from mining flue gases, the interfering ions (chlorine ions) are washed with water.

A number of systems recently applied use aqueous solutions of chemical products that are particularly expensive, as a result of which not enough is known about the physical and physicochemical conditions required for the various types. of waste material, or about the amounts to be used in order to ensure the desired results.

In U.S. Pat. No. 4,737,356, the immobilization of lead and cadmium contained in solid residues takes place by the addition of water soluble. phosphate source. According to a specific embodiment, a mixture of $Na_5P_3O_{10}$ and 85% $H_3PO_4$ (1:1) is used.

There is thus a need, in this specific field, to have available a versatile method which does not require particular pre-treatments and which uses readily available and low-cost reagents, to be added in modest amounts in order-to minimize the variations of the final weight.

SUMMARY OF THE INVENTION

The present invention makes it possible to satisfy the abovementioned requirements by also offering other advantages which will become apparent hereinbelow.

The subject of the present invention is thus a method for treating waste material contaminated with heavy metals so as to make the waste material inert by adding a water soluble phosphate source, wherein the material to be made inert, which is optionally at least in part neutralized, is subjected to the following operations, optionally under stirring:

- addition of a concentrated aqueous solution of orthophosphoric acid and of an alkaline or an alkaline earth salt thereof in a molar ratio ranging from 1:5 to 5:1;
- optionally, addition of water to give the homogeneous paste thus obtained a sufficient moisture content, the resulting homogeneous paste being placed in the open air to help it dry out;
- addition of calcium hydroxide and/or calcium oxide.

DETAILED DESCRIPTION OF THE INVENTION

EXAMPLE

The inertization method according to the invention is applied to fly ash from the incineration of hospital waste. This material is introduced into a mixer. In parallel, calcium hydroxide is pneumatically added from suitable hoppers, in an amount of 90 kg per tori of waste, 50 liters of the "Fissa Met", i.e. an inertizing solution, which in the present example consists of a concentrated aqueous solution of orthophosphoric acid and of the hydrogen disodium salt thereof (disodium monohydrogen phosphate ($Na_2HPO_4$)), is added from another tank, together with just enough water to enhance the intimate contact of the mixture. The mixture needs to maintain a stirrable consistency and to be kept stirring for a few minutes.

At the end of this operation, the wet mixture is emptied out onto a suitable surface to help it to dry out completely, or is dried directly in a stream of hot air (whenever heat recovery is possible).

When subjected to eluate tests, the material resulting from the treatment revealed a release of lead, cadmium, copper and selenium which was within the acceptability limits for direct dumping (without additional treatment) in a secured landfill.

The original values of the metal concentrations in the eluate with a 0.5 M solution of acetic acid before and after the treatment are given for comparative purposes in Tables 1 and 2.

TABLE 1

| METAL | BEFORE THE TREATMENT ELUATE (mg/l) | AFTER THE TREATMENT ELUATE (mg/l) | ACCEPTED LIMITS |
|---|---|---|---|
| Lead | 10.500 | 0.200 | 0.200 |
| Cadmium | 6.400 | 0.020 | 0.020 |
| Copper | 0.600 | 0.100 | 0.100 |
| Selenium | 0.030 | 0.030 | 0.030 |

TABLE 2

| | FLY ASHES FROM MUNICIPAL WASTE INCINERATOR | | | METALLURGIC SLAGS | | | METALLURGIC FLY ASHES | | | VARIOUS MATERIALS | | |
|---|---|---|---|---|---|---|---|---|---|---|---|---|
| TESTS | C.M.* (mg/l) | eluate (mg/l) | eluate inert. (mg/l) | C.M.* (mg/l) | eluate (mg/l) | eluate inert. (mg/L) | C.M.* (mg/l) | eluate (mg/l) | eluate inert. (mg/l) | C.M.* (mg/l) | eluate (mg/l) | eluate inert. (mg/l) |
| Lead | 1400 | 8.00 | <0.02 | 87000 | 10.00 | 0.20 | 30000 | 250 | 0.20 | 12.500 | 100 | 0.20 |
| Cadmium | 400 | <0.02 | <0.02 | 160 | 0.12 | 0.01 | 525 | 15 | <0.02 | 25 | 0.40 | 0.02 |
| Copper | 75 | <0.10 | <0.10 | — | — | — | 1650 | 10 | <0.10 | 0.10 | 15 | 0.10 |

*C.M. stands for "Crude Waste Material to be treated"

I claim:

1. A method for treating waste material contaminated with heavy metals comprising:

a. adding a concentrated aqueous solution of orthophosphoric acid and an alkaline or alkaline earth salt of orthophosphoric acid to the waste material to form a homogeneous paste;

b. adding to the homogeneous paste at least one member of the group consisting of calcium oxide and calcium hydroxide;

c. drying the homogeneous paste.

2. The method according to claim 1 wherein the waste material is at least in part neutralized.

3. The method according to claim 2 wherein the waste material is at least in part neutralized by a neutralizing agent selected from the group consisting of sodium hydroxide, potassium hydroxide, and calcium hydroxide.

4. The method according to claim 3 wherein the calcium oxide or calcium hydroxide are added in powder form in an amount of between 10 and 350 kg per ton of waste material.

5. The method according to claim 1 wherein the calcium oxide or calcium hydroxide are added in powder form in an amount of between 10 and 350 kg per ton of waste material.

6. The method according to claim 1 wherein water is added to the homogeneous paste.

7. The method according to claim 1 wherein the concentrated aqueous solution of orthophosphoric acid and an alkaline or alkaline earth salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)_2$, $Ca_3(PO_4)_2$, wherein said at least one member of the group is added in an amount of from 1 and 200 liters per ton of waste material.

8. The method according to claim 2 wherein the concentrated aqueous solution of orthophosphoric acid and an alkaline salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)$, $Ca_3(PO_4)_2$, wherein said at least one member of the group is added in an amount of from 1 and 200 liters per ton of waste material.

9. The method according to claim 3 wherein the concentrated aqueous solution of orthophosphoric acid and an alkaline salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)$, $Ca_3(PO_4)_2$, wherein said at least one member of the group is added in an amount of from 1 and 200 liters per ton of waste material.

10. The method according to claim 4 wherein the concentrated aqueous solution of orthophosphoric acid and an alkaline salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)$, $Ca_3(PO_4)_2$, wherein said at least one member of the group is added in an amount of from 1 and 200 liters per ton of waste material.

11. The method according to claim 5 wherein the concentrated aqueous solution of orthophosphoric acid and an alkaline salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)$, $Ca_3(PO_4)_2$, wherein said at least one member of the group is added in an amount of from 1 and 200 liters per ton of waste material.

12. The method according to claim 6 wherein the concentrated aqueous solution of orthophosphoric acid and an alkaline salt thereof comprises at least one member of the group consisting of anhydrous or hydrated $NaH_2PO_4$, $Na_2HPO_4$, $Na_3PO_4$, $KH_2PO_4$, $K_2HPO_4$, $K_3PO_4$, $CaHPO_4$, $Ca(H_2PO_4)$, $Ca_3(PO_4)_2$, wherein said at least one member of the group is added in an amount of from 1 and 200 liters per ton of waste material.

13. The method according to claim 7 wherein said concentrated aqueous solution is added in an amount of between 5 and 150 liters per ton of waste material.

14. The method according to claim 8 wherein said concentrated aqueous solution is added in an amount of between 5 and 150 liters per ton of waste material.

15. The method according to claim 9 wherein said concentrated aqueous solution is added in an amount of between 5 and 150 liters per ton of waste material.

16. The method according to claim 10 wherein said concentrated aqueous solution is added in an amount of between 5 and 150 liters per ton of waste material.

17. The method according to claim 11 wherein said concentrated aqueous solution is added in an amount of between 5 and 150 liters per ton of waste material.

18. The method according to claim 12 wherein said concentrated aqueous solution is added in an amount of between 5 and 150 liters per ton of waste material.

* * * * *